US008551596B2

(12) United States Patent
Chou

(10) Patent No.: US 8,551,596 B2
(45) Date of Patent: Oct. 8, 2013

(54) SELF-STICKING FABRIC

(75) Inventor: Chao-Mu Chou, Taipei (TW)

(73) Assignees: Chao-Mu Chou, Taipei (TW); Shin-Yin Cheng, Taipei (TW)

( * ) Notice: Subject to any disclaimer, the term of this patent is extended or adjusted under 35 U.S.C. 154(b) by 421 days.

(21) Appl. No.: 12/792,897

(22) Filed: Jun. 3, 2010

(65) Prior Publication Data

US 2010/0313388 A1 Dec. 16, 2010

(30) Foreign Application Priority Data

Jun. 16, 2009 (TW) ..... 98120034 A

(51) Int. Cl.
*A44B 18/00* (2006.01)

(52) U.S. Cl.
USPC ..... 428/99; 24/442; 428/95; 428/98; 428/223

(58) Field of Classification Search
USPC ..... 428/99, 95, 98, 223; 24/442
See application file for complete search history.

(56) References Cited

U.S. PATENT DOCUMENTS

| | | | | |
|---|---|---|---|---|
| 4,624,116 | A * | 11/1986 | Rogers | 66/193 |
| 2004/0166282 | A1* | 8/2004 | Kingsford et al. | 428/95 |
| 2006/0144098 | A1* | 7/2006 | Chou | 66/195 |
| 2010/0162536 | A1* | 7/2010 | Chou | 24/442 |

* cited by examiner

*Primary Examiner* — Brent O'Hern
(74) *Attorney, Agent, or Firm* — Guice Patents PLLC

(57) ABSTRACT

A self-sticking fabric structure includes loop-like fabric structure, which is fabricated by the yarns of the conjugate fiber and split thereafter to recover smaller fibers, substantially all of the fibers forming loop-like fastening elements between the intersection of interlacing or interlooping, and a hook fabric structure, which is fabricated by the yarns of staple fibers for enabling the ends of the staple fibers to protrude over the surface of the fabric and to form a layer of fiber flock type hook-like fastening elements. The fabrication of the self-sticking fabric does not require any further brushing or pile-raising processing process, saving the manufacturing cost, reducing the fabric thickness, and widening the application of the fabric.

11 Claims, 5 Drawing Sheets

SELF-STICKING FABRIC

BACKGROUND OF THE INVENTION

1. Field of the Invention

The present invention relates to fabrics and more particularly, to a thin and fine structure of self-sticking fabric having the similar snapping effect of traditional VELCRO.

2. Description of the Related Art

VELCRO, a leading brand of hook and loop surface fastener, as a conventional sticking or gripping fabrics can be found in our living environment and widely used in garment, leather goods, shoes, diaper, helmet, etc. The major reason is that the VELCRO is convenient in sticking, eliminating the drawback of inconvenience in use as encountered in conventional snap buttons and zip fasteners.

However, there are some unsatisfied drawbacks in using VELCRO, for example, VELCRO is stiff in texture, has a certain thickness and is difficult to produced directly connected to the fabric. Normally, it should be by sewing or other ways to attach or connect the VELCRO on the articles which using said VELCRO. Therefore, if the articles using VELCRO requires to be soft in texture or less thick than the thickness of VELCRO, due to the texture of VELCRO material, the VELCRO is difficult to meet such requirements.

Taiwan Utility Model Publication No. 479,477 is relating to thin base fabrics having a sticking surface knitted by a single filament. It disclosed a sticking fabric with a base fabric which formed by each weft filament being knitted to become a node then each adjacent nodes being interlocked to form a pair of inlay, then, by interlocking continuous nodes to form the strips of combining the base warp tissues. That means, the base fabrics of said sticking fabrics is made by single filament, under special knitting for to the curving floating circles thereby providing a thinner VELCRO. The fact prevents the trouble caused by the thickness of VELCRO.

Beside the above-mentioned thickness issue, there is still a problem of unintended adherence. The reason is that the loops of convention snapping fabrics are too large in dimension which providing the opportunity of small things to insert through or fall within the loops.

Further, U.S. Pat. Nos. 5,231,738; 5,369,853; 5,515,583; 5,745,961 commonly have hook-like fastening elements and loop-like fastening elements be provided on one same side of a base fabric, enhancing application convenience. Similar to conventional snapping fabric designs, the hook-like fastening elements are prepared by using hooked-like single filaments having a diameter of 0.1 mm~0.4 mm, and the loop-like fastening elements are multifilament yarns consisting of single filaments having a diameter of 20μ to 100μ.

Further, Taiwan Utility Model Publication No. M263013 (equivalent to U.S. Pat. No. 7,231,789), issued to the present inventor, discloses a snapping fabric structure entitled "Snapping Fabrics". Taiwan Patent Application Number 097151634, filed by the present inventor, teaches the use of a shearing technique to form fibriform hooks. According to these two prior art inventions, a hairiness treatment of brushing or shearing is applied to form fibriform hooks. However, employing a brushing or shearing technique to form fibriform hooks is still too thick for using on delicate imitate clothing.

SUMMARY OF THE INVENTION

The present invention has been accomplished under the circumstances in view. It is therefore the main object of the present invention to provide a thin thickness of self-sticking fabric having a loop fabric structure and a hook fabric structure where the loop fabric structure is split after fabrication to recover smaller fibers, substantially all of the fibers forming loop-like fastening elements between the intersection of interlacing or interlooping; the hook fabric structure is completed after knitting or weaving without any further extra processing process, having fine and thin characteristics and enhanced sticking power.

To achieve this and other objects of the present invention, a self-sticking fabric comprises a loop fabric structure and a hook fabric structure. The loop fabric structure is fabricated by the yarns of the conjugate fibers and split thereafter to recover smaller fibers, substantially all of the fibers forming loop-like fastening elements between the intersection of interlacing or interlooping. The hook fabric structure is fabricated by the yarns of staple fibers for enabling the ends of the staple fibers to protrude over the surface of the fabric and to form a layer of fiber flock type hook-like fastening elements.

After examination of a self-sticking fabric made according to the present invention, the diameter of the fibers of the hook-like fastening elements of the hook fabric structure is about 0.02 mm; the diameter of the loop-like fastening elements of the loop fabric structure is about 5μ. Thus, when compared to prior art designs, the invention can prevent the other things from inserting therein or adhering thereto. Further, unlike the orderly arranged hook-like fastening elements of thick mono-filament or plastics of the prior art US patent designs, the hook fabric structure is formed of irregularly disposed fiber flock and suitable for making underwear, pajama and muffler for comfort wearing.

DETAILED DESCRIPTION OF THE PREFERRED EMBODIMENT

Figure 1:
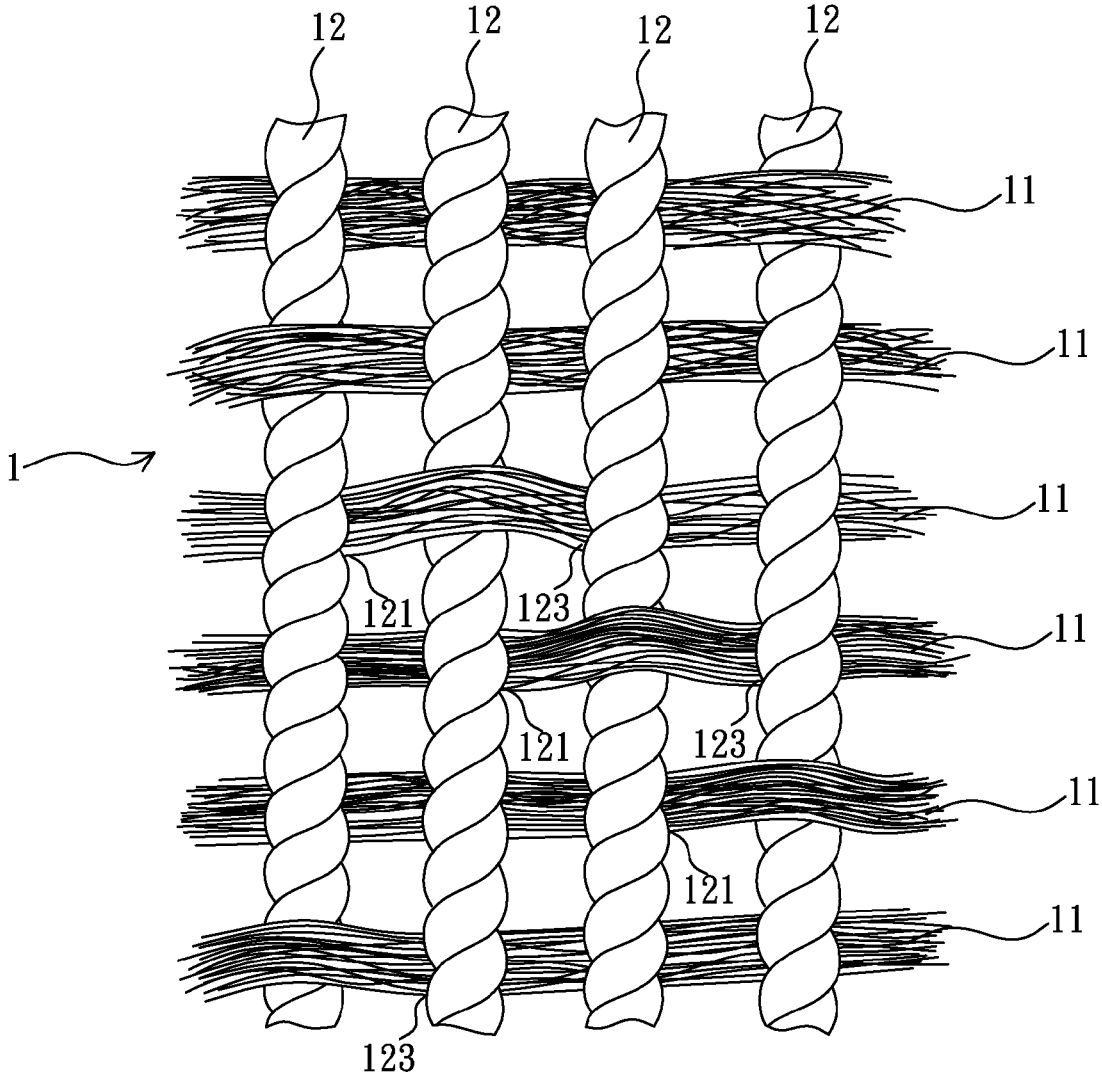
FIG. 1 is a schematic view in an enlarged scale of a self-sticking fabric in accordance with the present invention.
Figure 2:
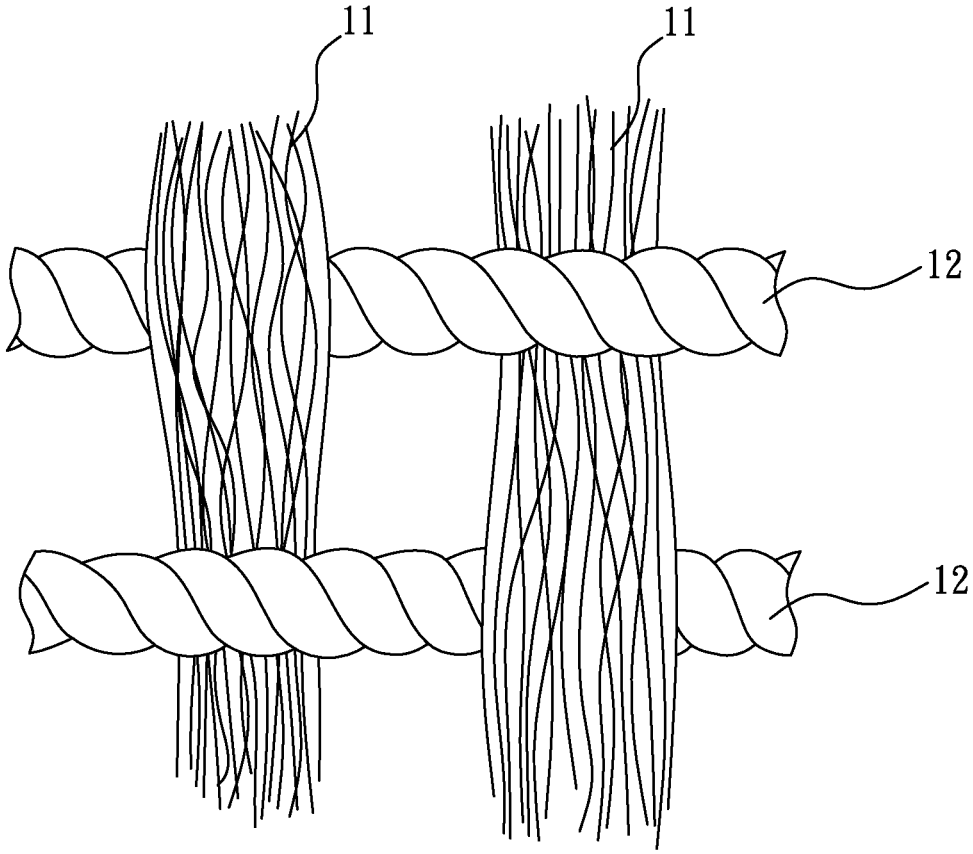
FIG. 2 is an enlarged view of a part of FIG. 1.

As shown in FIGS. 1 and 2, basically, a self-sticking fabric 1 in accordance with the present invention is a blended fabric prepared from thermoplastic synthetic staple fibers and micro fibers by means of a weaving machine.

The self-sticking fabric 1 comprises a loop fabric structure 11 and a hook fabric structure 12.

The loop fabric structure 11 includes a plurality of loop-like fastening elements which are the intensive and loosen single micro-fiber of the yarn between the the intersection of interlacing or interlooping 121 and 123, functioning similar to the loops of a conventional Velcro tape.

In actual practice, the loop fabric structure 11 can be made by micro-fiber, which has the diameter, less than 1 denier. The production of micro-fiber is a mature technology.

The normal process may adopt two different high molecular materials become the complex (or call conjugated) fiber by complex spinning and then separating each single complex fiber (normally call splitting) into a bunch of micro-fibers. Therefore, the loop fabric structure 11 of the present invention is by weaving the micro-fiber yarn then splitting them to form the loosen but intensive micro-fibriform loops between the the intersection of interlacing or interlooping of the yarn, as shown in FIG. 2. The method of splitting can be carried out by chemical process as well as mechanical process. The chemical process (alkali treatment) is by chemical solvent to dissolve one of the two materials but leave the other one. If by the mechanical method, two different complex fibers can be separated by mechanically rubbing.

Figure 3:
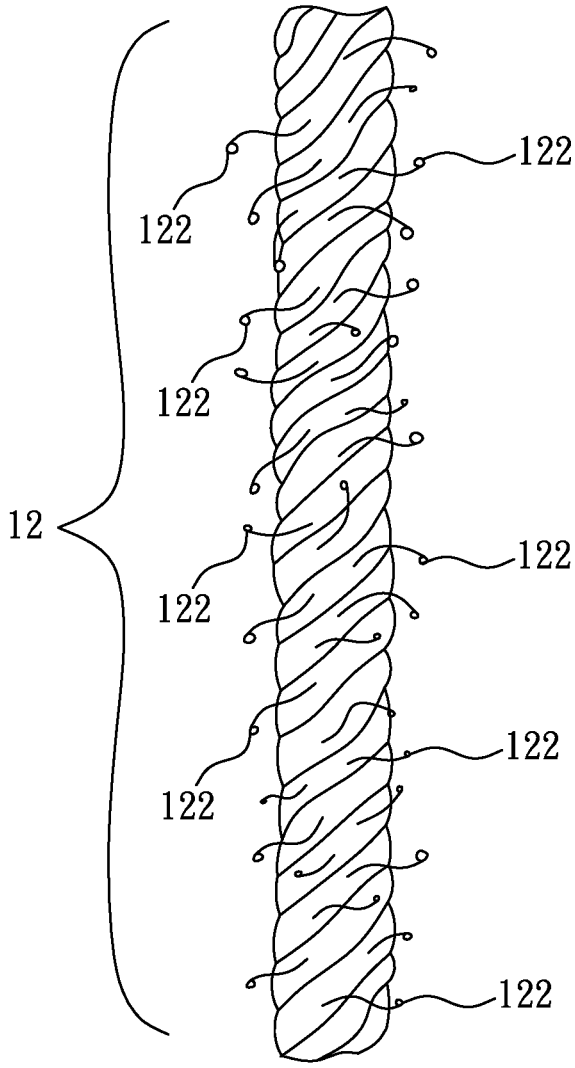
FIG. 3 is an enlarged view of a part of the present invention, showing the structure of one single yarn of the hook fabric structure.

The hook fabric structure 12 is formed of the yarns of staple fibers. The hook-like fastening elements of the hook fabric structure 12 can be formed by:

1) weaving or knitting stable fibers with micro fibers into a inter-woven fabric, such that the ends of the staple fibers protrude over the surface of the fabric to form a layer of fiber flock type hook-like fastening elements (hook fabric structure 12) detachably fastenable to the loop fabric structure 11;

2) weaving or knitting thermoplastic synthetic staple fiber blended yarns with micro fibers into a inter-woven fabric, and then singe the surface of the fabric to melt the ends of the thermoplastic synthetic staple fibers into beads 122 (see FIG. 3), thereby forming the desired hook-like fastening elements (hook fabric structure 12) detachably fastenable to the loop fabric structure 11;

3) weaving or knitting blended yarns containing at least one thermoplastic synthetic staple fiber with micro fibers into a inter-woven fabric, and then singe the surface of the fabric to melt the ends of the thermoplastic synthetic staple fibers into beads 122 (see FIG. 3), thereby forming the desired hook-like fastening elements (hook fabric structure 12) detachably fastenable to the loop fabric structure 11;

4) weaving or knitting blended yarns containing at least one thermoplastic synthetic staple fiber with micro fibers into a double-layer inter-woven fabric, and then cutting the knitted or woven double-layer inter-woven fabric into two pieces where each piece has a layer of fiber flock type hook-like fastening elements (hook fabric structure 12) on its one side that are detachably fastenable to the loop fabric structure 11.

Therefore, subject to one of the aforesaid four hook-like fastening elements formation methods, the hook fabric structure 12 has the function of hook-like fastening elements of conventional Velcro tapes.

In actual practice, when the hook fabric structure 12 and the loop fabric structure 11 are attached together face to face, the beads 122 of the hook-like fastening elements or layer of fiber flock type hook-like fastening elements of the hook fabric structure 12 will be hooked or restrained by loop fabric structure 11, thereby achieving the anti-pulling effect or adherence, which the conventional sticking fabrics have.

Figure 4:
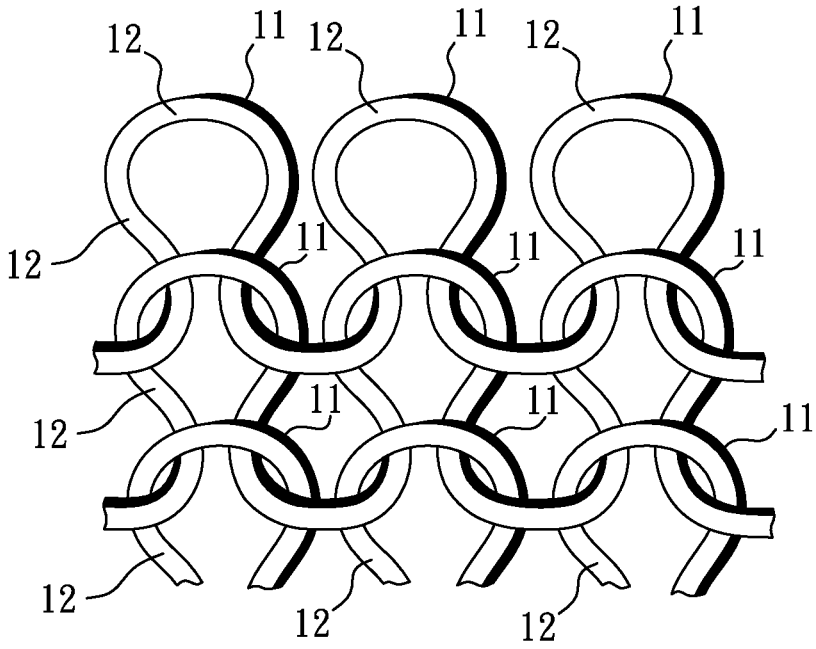
FIG. 4 is a schematic drawing of the present invention, showing the hook fabric structure and the loop fabric structure located on two opposite sides of the knit fabric.
Figure 5:
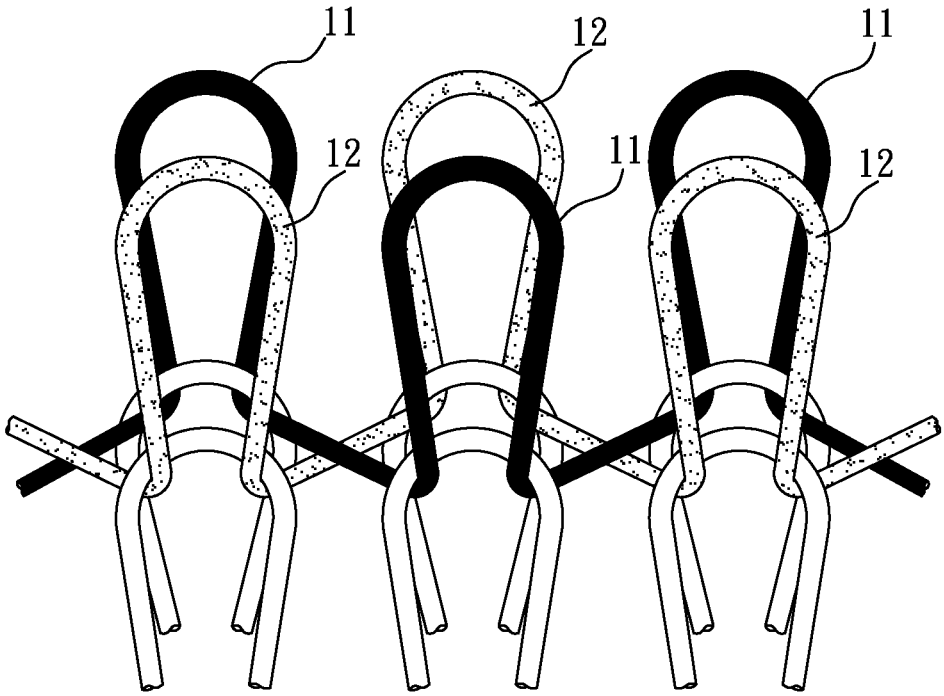
FIG. 5 is a schematic drawing of the present invention, showing the hook fabric structure and the loop fabric structure located on each of the two opposite sides of the knit fabric.

Subject to the application, as shown in FIGS. 4 and 5, the loop fabric structure 11 and the hook fabric structure 12 can be arranged at opposite sides of one same piece of fabric, or at different locations on the same side of one same piece of fabric, or respectively arranged on two different pieces of fabric.

Therefore, by adopting the present invention, the advantages and effects can be achieved are:

1) The thickness of the sticking fabric can be effectively reduced. More particularly, it is not necessary to brush the hook fabric structure to form erected, dispersed fiber bundles of hook-like fastening elements when the hook fabric structure is made, thus the thickness of the self-sticking is minimized.

2) The invention does not require any base fabric or substrate material. Because the self-sticking fabric of the present invention forms the loop fabric structure and the hook fabric structure directly on the surface thereof, it provides a self-sticking function. Based on its soft texture characteristic, the self-sticking fabric can be used for making medical textile products, facilitating wearing or application.

3) The diameter of the fibers of the hook fabric structure is much smaller than the human hair. Thus, the fibers of the hook fabric structure can prevent the user from skin stimulating, also prevent the other things from inserting therein or adhering thereto, also prevent damage to other clothes during washing.

4) The self-sticking fabric is made like the knitting of regular fabrics and can be cut freely subject to any desired shapes for full-surface sticking; when used as a band strip, one single piece of band strip can be used to wrap different parts of the body; due to a wide range of sticking application, the invention is a breakthrough in sticking fabric industry.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A self-sticking fabric comprising:

a loop fabric structure being a micro-fiber yarn having conjugate fibers split into smaller fibers; and a hook fabric structure being a hook yarn having staple fibers, the hook yarn is woven or knitted with the micro-fiber yarn;

wherein the conjugate fibers of the loop fabric structure form loop-like fastening elements between two adjacent intersections of interlacing or interlooping of the micro-fiber yarn and ends of the staple fibers of the hook fabric structure protrude outwardly from a surface of the hook fabric structure forming a layer of fiber flock type hook-like fastening elements selectively hooking with selected loop-like fastening elements of the loop fabric structure;

wherein the hook fabric structure and said loop fabric structure are integrally formed with the self-sticking fabric.

2. The self-sticking fabric structure as claimed in claim 1, wherein said split is by chemical method of alkali treatment to dissolve one of the fibers by using alkaline as an agent for volume reduction.

3. The self-sticking fabric structure as claimed in claim 1, wherein said split is by mechanical method to separate the different material fibers.

4. The self-sticking fabric structure as claimed in claim 1, wherein said hook fabric structure is formed by knitting or weaving blended yarns containing thermoplastic synthetic staple fibers into an inter-woven fabric, and then singe the surface of the fabric to melt the ends of the thermoplastic synthetic staple fibers into beads.

5. The self-sticking fabric structure as claimed in claim 1, wherein said hook fabric structure is formed by knitting or weaving thermoplastic synthetic staple fiber yarns with micro-fiber yarns into an inter-woven fabric, and then singe the surface of the fabric to melt the ends of the thermoplastic synthetic staple fibers into beads.

6. The self-sticking fabric structure as claimed in claim 1, wherein said hook fabric structure is formed by knitting or weaving thermoplastic synthetic staple fiber yarns with micro-fiber yarns into a double-layer inter-woven fabric and then cutting the knitted or woven double-layer inter-woven fabric into two pieces where each cut piece has a layer of fiber flock type hook-like fastening elements on one side thereof.

7. The self-sticking fabric structure as claimed in claim 1, wherein said hook fabric structure and said loop fabric structure are located on two opposite sides of the self-sticking fabric.

8. The self-sticking fabric structure as claimed in claim 1, wherein said hook fabric structure and said loop fabric structure are located on different locations of one same side of the self-sticking fabric.

9. The self-sticking fabric structure as claimed in claim 1, wherein said hook fabric structure and said loop fabric structure are located on different locations of each of two opposite sides of the self-sticking fabric.

10. The self-sticking fabric structure as claimed in claim 1, wherein said micro-fiber yarn has a diameter less than one denier.

11. The self-sticking fabric structure as claimed in claim 1, said hook-like fastening elements are integrally formed on said ends of said staple fibers of said hook fabric structure.

* * * * *